United States Patent [19]

Dabney

[11] Patent Number: 4,907,785

[45] Date of Patent: Mar. 13, 1990

[54] LIMITED DEFLECTION SPRING

[75] Inventor: Upton R. Dabney, Georgetown, Ky.

[73] Assignee: Hoover Group, Inc., Roswell, Ga.

[21] Appl. No.: 397,630

[22] Filed: Aug. 22, 1989

Related U.S. Application Data

[63] Continuation of Ser. No. 237,846, Aug. 29, 1988, abandoned.

[51] Int. Cl.[4] ..... F16F 3/02

[52] U.S. Cl. ..... 267/104; 5/247; 5/255; 5/476

[58] Field of Search ..... 267/103, 104, 105, 106, 267/107, 108, 109, 110, 111; 5/247, 255, 260, 261, 263, 264 R, 476

[56] References Cited

U.S. PATENT DOCUMENTS 4,339,834 7/1982 Mizelle ..... 267/107 X 4,559,654 12/1985 Mizelle ..... 5/247 X

*Primary Examiner*—George E. A. Halvosa

*Attorney, Agent, or Firm*—Harness, Dickey & Pierce

[57] ABSTRACT

A spring for a box assembly that is constructed to limit deflection of the spring to a position in which the spring is not overstressed. The limited deflection spring includes a wire body which has a load bearing portion, an upright yieldable portion, and a foot portion. The upright yieldable portion includes a pair of downwardly extending converging connecting bars integral at their upper ends with torsion bars at opposite ends of the load bearing portion. A pair of lower torsion bars are connected to the lower ends of the connecting bars and are spaced inward from a pair of downwardly extending converging wire columns which are connected at their upper ends to the lower torsion bars. As a downward load is applied to the load bearing portion, the wire columns move toward vertical positions in which they limit further deflection of the spring.

3 Claims, 2 Drawing Sheets

LIMITED DEFLECTION SPRING

This is a continuation of U.S. application Ser. No. 237,846, filed Aug. 29, 1988, now abandoned.

BACKGROUND AND SUMMARY OF THE INVENTION

This invention relates generally to mattress foundation structures and more particularly to a box spring assembly of the type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; 3,852,838; 4,060,862; 4,120,058; 4,131,961; 4,195,376; 4,218,790; 4,238,861; 4,251,892; 4,253,208; 4,339,834; 4,470,584; and 4,739,977.

Box spring assemblies of the general type shown in the above list of patents, all of which are owned by the assignee of this application, are advantageous with respect to the conventional box spring assemblies using coil springs because they provide a desired stiffer foundation for the mattress and contain a reduced amount of wire. These box spring assemblies are also advantageous from the standpoint of prolonged service life, ease of assembly, and cost of manufacture.

Additional box spring assemblies of this general type are shown in U.S. Pat. Nos. 3,546,723; 3,596,299; 3,722,013; 3,825,960; 3,833,948; 3,835,485; 3,869,740; 3,990,121; and 4,000,531.

The principal objects of this invention are to provide an improved spring for box spring assemblies which has limited deflection characteristics to avoid overstressing of the spring during loading, reduce points of stress concentration, and imparts a "flotation" feel to the box spring assembly user which is desirable from a comfort standpoint.

The spring according to the present invention has a load bearing portion at the upper end of an upright yieldable portion. The upright yieldable portion comprises a pair of downwardly extending and converging connecting bars integral at their upper ends with the load bearing portion, a pair of lower torsion bars at the lower end of the connecting bars, and a pair of downwardly extending and converging wire columns located at their upper ends outwardly of the lower torsion bars. Connecting wire sections join the lower torsion bars with the upper ends of the columns. The wire columns are spaced inwardly of the load bearing portion at the upper end of the spring to reduce the likelihood of metal-to-metal contact during deflection with an undesirable "clicking" noise.

As a downwardly directed load is applied to the load bearing portion, the upright columns move toward each other and inward thus causing the upright columns to approach a vertical orientation. When the upright columns reach a substantially vertical orientation, full deflection is reached. The connecting wire sections joining the lower torsion bars with the columns are vertically aligned with spaces in the mattress support deck in between the metal members which form the deck. Thus the clicking sound associated with springs meeting deck members is avoided.

Additional benefits and advantages of the present invention will become apparent to those skilled in the art to which this invention relates and from the subsequent description of the preferred embodiment and the appended claims taken in conjunction with the accompanying drawing.

DETAILED DESCRIPTION OF THE PREFERRED EMBODIMENT

Figure 1:
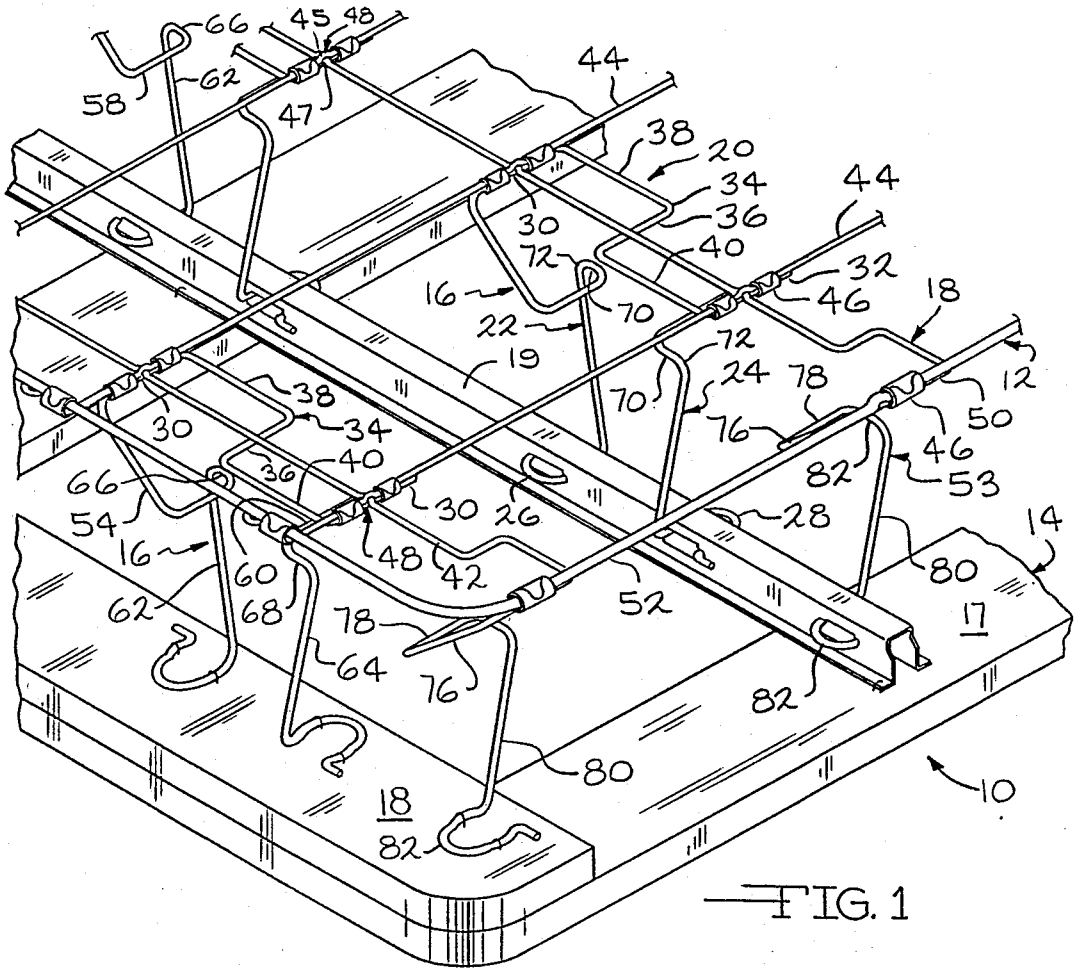
FIG. 1 is a fragmentary perspective view of a portion of a box spring assembly incorporating the springs of this invention.

A box spring assembly utilizing springs in accordance with the present invention is shown in FIG. 1 and is generally designated by reference numeral 10. Box spring assembly 10 generally consists of a mattress support deck 12 supported in a position above and substantially parallel to a rectangular box spring frame 14 having a pair of side rails 17 and a pair of end rails 18, only one of each being shown in FIG. 1. The frame 14 also includes a plurality of cross rails 19, only one of which is shown. A plurality of deck support springs 16 and cross wire springs 18 support the deck 12 on the frame 14.

A deck support spring 16 comprises a substantially horizontal load bearing portion 20 and a pair of downwardly extending yieldable portions 22 and 24 terminating at their lower ends in a pair of feet 26 and 28. Load bearing portion 20 comprises a pair of parallel, spaced apart upper torsion bars 30 and 32 connected together by an intermediate connecting section 34. Intermediate connecting section 34 consists of center bar 36 which is parallel to and midway between torsion bars 30 and 32, and connecting bars 38 and 40 which connect the ends of center bar 36 to the torsion bars 30 and 32.

Load bearing portion 20 is positioned in a substantially horizontal plane against mattress support deck 12 such that center bar 36 crosses beneath the load bearing portion 42 of cross wire spring 18. In addition, the upper torsion bars 30 and 32 are positioned parallel to and against a pair of adjacent long wires 44 and are clipped thereto by pairs of clips 46.

Mattress support deck 12 consists of long wires 44 and cross wire springs 18 positioned in a crisscross fashion with the load bearing portions 42 of cross wire springs 18 intersecting long wires 44. Each long wire 44 has a plurality of spaced apart notches 45 along its length. Likewise, each load bearing portion 42 of cross wire springs 18 has a plurality of spaced notches 47. Each of the notches is an upwardly arched deflection in the wire member. Notches 45 saddle notches 47 to form intersections 48. Notches 47 in turn saddle one of the torsion bars 30 or 32.

The engaged notches 45 and 47 in long wires 44 and load bearing portions 42 of cross wire springs 18 respectively prevent sideways movement of the wire members at the notched intersections 48 between long wires 44 and the load bearing portion 42 of cross wire springs 18. When clips 46 are installed around long wires 44 and torsion bars 30 and 32 of deck support springs 16, the mattress support deck 12 becomes a fixed wire deck with each cross wire spring 18 clamped between notche 45 and a torsion bar 30 or 32.

As shown in FIG. 1, each of the cross wire springs 18 includes a torsion bar 50 at each end of load bearing portion 42. Torsion bar 50 is secured to border 52 by another clip 46. The upright yieldable portion 53 of cross wire spring 18 is identical to upright yieldable portions 22 and 24 of deck support springs 16 as will be subsequently described.

Upright yieldable portions 22 and 24 comprise a pair of downwardly extending and converging connecting bars 54 and 56 which join one end each of the torsion bars 30 and 32 to a pair of horizontal lower torsion bars 58 and 60 at the lower end of the connecting bars. The lower torsion bars 58 and 60 extend transversely of the connecting bars 54 and 56.

Below the lower torsion bars 58 and 60 are a pair of downwardly extending and converging wire columns 62 and 64 located with their upper ends extending outwardly of lower torsion bars 58 and 60 respectively. Wire columns 62 and 64 are connected to lower torsion bars 58 and 60 by connecting wire sections 66 and 68. Connecting wire sections 66 and 68 each have a short straight portion 70 joined with the lower torsion bars and a downwardly curved portion 72 joining with the upright columns.

The combination of the connecting wire sections 66 and 68 and the upright columns forms a pair of facing columns of substantially "7" shape which spaces wire columns 62 and 64 outward from torsion bars 58 and 60, respectively. The connecting wire sections 66 and 68 thereby produce a moment arm between the upright columns and the lower torsion bars 58 and 60 when a load is applied to load bearing portion 20. The positioning of the upright wire columns with the connecting wire sections 66 and 68 directed toward each other transfers part of any downwardly applied load on the load bearing portion 20 from the torsion bars through the connecting wire sections to the upright columns. This transferred load increases as the columns approach a vertical orientation.

Figure 2:
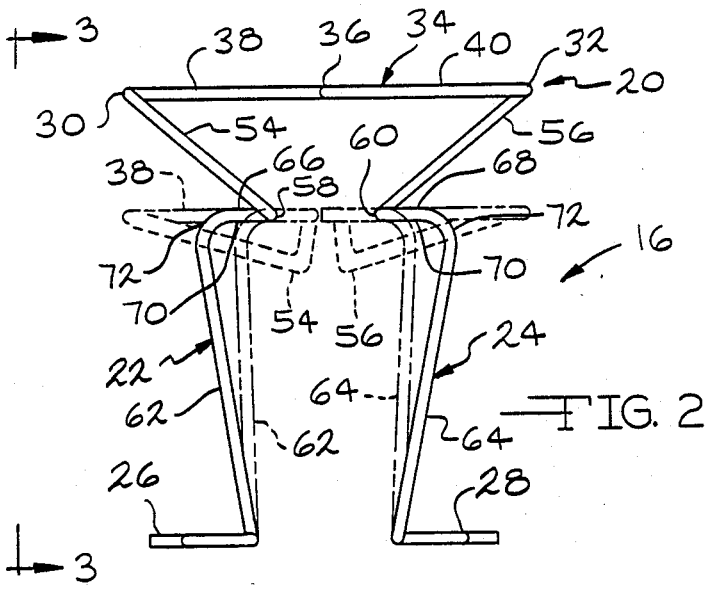
FIG. 2 is a side elevational view of one of the springs according to the present invention, showing the spring undeflected in solid lines and deflected downwardly to a limit position in broken lines.
Figure 3:
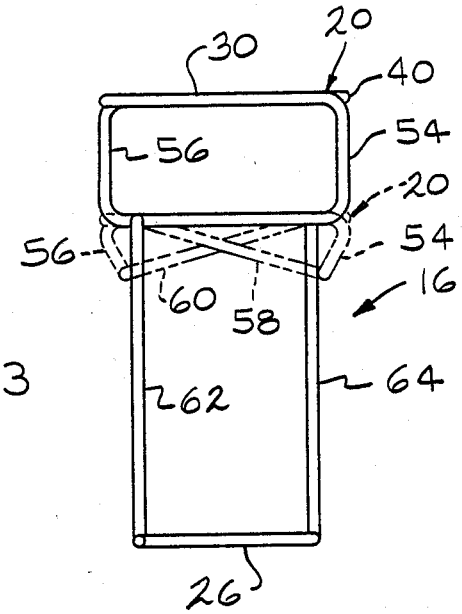
FIG. 3 is another side view of the spring taken in the direction of Arrow 3 in FIG. 2.

As shown in FIG. 2, the dotted lines represent the fully deflected position of the load bearing portion 20 illustrating that connecting bars 54 and 56 twist downward below the substantially horizontal level of load bearing portion 20 in the fully deflected position. The connecting wire sections 66 and 68, when the spring is fully deflected, remain generally in the plane of the load bearing portion 20. As can be seen in FIG. 3, lower torsion bars 58 and 60 twistingly deflect downward below load bearing portion 20 so as to not engage with the support deck 12 thus preventing any clicking sound when spring 16 is fully deflected.

As shown by the dotted lines in FIG. 2, as load bearing portion 20 moves to the fully deflected position, wire columns 62 and 64 move inwardly toward each other to substantially vertical spaced apart positions to positively limit further deflection. During deflection of a yieldable portion 22, 24 or 53, however, the deck 12 moves downwardly in a slowly yielding manner so as to impart a flotation feel to a user lying on a mattress supported on the deck 12. The yieldable portion 22, 24 and 53 are configured so that all parts absorb some of the load to thereby eliminate areas of stress concentration in which the elastic limit of the wire might be exceeded. The connecting wire sections 66 and 68 are vertically aligned with spaces in the mattress support deck 12 between the crisscrossed wires 44 and 18 to absorb shock loads on the deck without metal-to-metal contact.

The short top or moment arm presented by connecting wire sections 66 and 68 also transfers some of the load normally absorbed in torsion by lower torsion bars 58 and 60 to the wire columns 62 and 64 to prevent the torsion bars from exceeding their yield stresses. Accordingly, stresses are distributed throughout the spring when full deflection is reached.

As stated previously and as shown in FIG. 1, the yieldable portions 53 of cross wire springs 18 perform in an identical manner to the yieldable portions 22 and 24 of deck support springs 16. The only significant difference between cross wire springs 18 and deck support spring 16 lies in the length of load bearing portion 42 when compared to load bearing portion 20 of deck spring 16. Although not shown in the drawing, load bearing portion 42 of cross wire spring 18 extends fully across box spring assembly 10 therefore spanning multiple pairs of long wires 44.

At each end of the load bearing portion 42 are torsion bars 50 which are coupled via connecting bars 76 to lower torsion bars 78 which in turn join upright wire columns 80 via connecting wire sections 82. Upright wire columns 80 terminate in foot portions 82 identical to feet 26 and 28. Upper torsion bar 50 is clipped via clips 46 to border wire 52.

As with the deck support spring 16, when cross wire spring 18 is fully deflected part of the load is transferred via connecting wire section 82 to the upright column 80 limiting the full deflection of the spring 18 so that the torsion bar yield stresses are not exceeded. Thus the full box spring assembly 10 can absorb a higher total loading without reaching or exceeding the yield of a torsion bar portion of a spring while allowing additional shock absorption capability and eliminating the noisy clicks associated with conventional connecting bars contacting the wire grid members at full deflection.

While the above description constitutes the preferred embodiment of the present invention, it will be appreciated that the limited deflection springs of the present invention are susceptible to modification, variation and change without departing from the proper scope and the fair meaning of the accompanying claims.

What is claimed is:

1. A limited deflection spring for a box spring assembly comprising:

a wire body having an upright yieldable portion and a load bearing portion at the upper end of said upright portion, said load bearing portion being substantially horizontal and having a pair of ends, said upright yieldable portion comprising a pair of downwardly extending converging connecting bars integral at their upper ends with opposite ends of said load bearing portion, a pair of lower torsion bars at the lower ends of said connecting bars, said lower torsion bars extending transversely of said connecting bars, a pair of downwardly extending and converging wire columns located at their upper ends outwardly of said lower torsion bars, wherein the upper end of one column is connected to one end of one lower torsion bar by wire sections and the upper end of the other column is connected to the opposite end of the other lower torsion bar by wire sections so that during deflection of said yieldable portion, said lower torsion bars are inclined downwardly in relatively reverse directions, a pair of substantially horizontal mounting feet integral with the lower ends of said converging wire columns and located beneath said load bearing portion, said feet being located in a horizontally spaced relation, said connecting wire sections including downwardly curved portions providing moment arms to partially transfer torsional stresses from said lower torsion bars to said columns so that a downwardly directed load applied to said load bearing portion causes said converging wire columns to move toward vertical positions and said torsion bars to move downwardly and inwardly thereby limiting further deflection of said spring, said spaced feet enabling said converging wire columns, as they move toward said vertical positions due to said downwardly directed load to remain spaced as said spring is fully deflected.

2. The spring according to claim 1 wherein said connecting wire sections also include straight portions which are generally parallel to each other and spaced from said load bearing portion so that said connecting sections do not engage said load bearing portion when said spring is deflected to a limit position in which said load bearing portion is located at substantially the level of the upper ends of said columns.

3. The spring according to claim 2 wherein said opposite ends of said load bearing portion are longer than said lower torsion bars and are disposed outwardly of said columns so as to avoid engagement with said columns during deflection of said spring.

* * * * *